United States Patent [19]

Bowne

[11] Patent Number: 4,960,685

[45] Date of Patent: Oct. 2, 1990

[54] COLOR PHOTOGRAPHIC ELEMENT AND PROCESS

[75] Inventor: Arlyce T. Bowne, Rochester, N.Y.

[73] Assignee: Eastman Kodak Company, Rochester, N.Y.

[21] Appl. No.: 453,523

[22] Filed: Dec. 20, 1989

[51] Int. Cl.[5] ..... G03C 1/46

[52] U.S. Cl. ..... 430/505; 430/553; 430/557; 430/558; 430/379; 430/383

[58] Field of Search ..... 430/505, 379, 383, 553, 430/557, 558

[56] References Cited

U.S. PATENT DOCUMENTS

| | | | |
|---|---|---|---|
| 4,228,233 | 10/1980 | Yagihara et al. | 430/553 |
| 4,296,200 | 10/1981 | Yagihara et al. | 430/553 |
| 4,401,752 | 8/1983 | Lau | 430/385 |
| 4,622,287 | 11/1986 | Umemoto et al. | 430/549 |
| 4,748,100 | 5/1988 | Umemoto et al. | 430/505 |
| 4,752,558 | 6/1988 | Shimura et al. | 430/505 |
| 4,806,459 | 2/1989 | Makino et al. | 430/505 |
| 4,840,878 | 6/1989 | Hirose et al. | 430/505 |
| 4,863,840 | 9/1989 | Komorita et al. | 430/553 |

FOREIGN PATENT DOCUMENTS

| | | | |
|---|---|---|---|
| 0162328 | 4/1985 | European Pat. Off. . | |
| 0200354 | 3/1986 | European Pat. Off. . | |
| 0230659 | 12/1986 | European Pat. Off. . | |
| 0231832 | 1/1987 | European Pat. Off. . | |
| 0284239 | 9/1988 | European Pat. Off. | 430/505 |
| 60-222852 | 2/1986 | Japan . | |

OTHER PUBLICATIONS

British Journal of Photography Annual 1982, pp. 201–203.

*Primary Examiner*—Paul R. Michl
*Assistant Examiner*—Thomas R. Neville
*Attorney, Agent, or Firm*—Richard E. Knapp

[57] ABSTRACT

A combination in a color photographic silver halide element and process of at least one red-sensitive silver halide emulsion layer comprising a particular naphtholic cyan dye-forming coupler with at least one green-sensitive silver halide emulsion layer comprising a particular pyrazolo[3,2-c]-s-triazole coupler and at least one blue-sensitive silver halide emulsion layer comprising a particular pivaloylacetanilide yellow dye-forming coupler enables improved color saturation of dye images, better relation of speed to grain characteristics and reduced unwanted spectral absorption of dye images formed. This combination is particularly useful in color photographic silver halide materials and processes for forming improved reversal dye images.

6 Claims, No Drawings

COLOR PHOTOGRAPHIC ELEMENT AND PROCESS

This invention relates to a particular combination of (A) at least one red-sensitive silver halide emulsion layer comprising a particular naphtholic cyan dye-forming coupler with (B) at least one green-sensitive silver halide emulsion layer comprising a particular pyrazolo[3,2-c]-s-triazole coupler, and (C) at least one blue-sensitive silver halide emulsion layer comprising a particular pivaloylacetanilide yellow dye-forming coupler in a color photographic element and process that enables formation of dye images having improved color saturation, better speed to grain characteristics and reduced unwanted spectral absorption. The invention relates particularly to such photographic elements and processes designed to form improved reversal dye images.

Color photographic recording materials typically contain silver halide emulsion layers sensitized to each of the red, green and blue regions of the visible spectrum with each layer having associated therewith a color-forming compound, typically a dye-forming coupler, that respectively yields a cyan, magenta or yellow image dye upon exposure and processing of the materials. The quality of the resulting color image is based primarily on the dye hues obtained from the respective color-forming compounds.

Combinations of couplers for color photographic recording materials have been explored for many years. Combinations of couplers in color photographic materials have been described in, for example, U.S. Pat. No. 4,622,287; U.S. Pat. No. 4,748,100; European Patent Application Nos. 230,659; 162,328; 231,832; 230,659 and Japanese Published Application No. 60-222,852. Attempts to alter absorption characteristics of image dyes in such materials has been typically focused on alterations of the structures of the coupler compounds. While this approach has involved a measure of success, the results in the final hue values of color images has not been predictable even after concentrated research efforts.

A continuing need has existed for a color photographic element and process, particularly such an element and process designed to provide an improved reversal dye image, that comprises a combination of couplers that provides improved color saturation of dye images, better relation of speed to grain characteristics and reduced unwanted spectral absorption of dye images formed with acceptable stability without the need for high levels of formaldehyde in processing compositions.

It has been found that such advantages are provided by a color photographic silver halide element comprising a support bearing at least one red-sensitive silver halide emulsion layer comprising at least one cyan dye-forming coupler, at least one green-sensitive silver halide emulsion layer comprising at least one magenta dye-forming coupler, and at least one blue-sensitive silver halide emulsion layer comprising at least one yellow dye-forming coupler wherein (A) the cyan dye-forming coupler is a 2- equivalent naphtholic coupler, comprising in the 2-position an amide group represented by the formula:

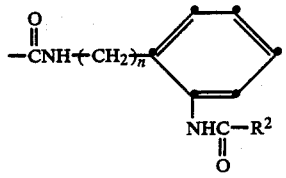

wherein n is 1 to 4, preferably 2, and $R^2$ is alkyl, such as alkyl containing 1 to 30 carbon atoms, or aryl, such as aryl containing 6 to 30 carbon atoms; and comprising in the 4- position a substituted phenoxy coupling-off group;

(B) the magenta dye-forming coupler is a pyrazolo[3,2-c]-s-triazole comprising a phenyl group in the 3-position or 6-position, particularly a substituted phenyl; and, (C) the yellow dye-forming coupler is a pivaloylacetanilide coupler comprising a substituted hydantoin or a phenoxy coupling-off group; when the coupling-off group of the yellow dye-forming coupler is phenoxy, the anilide moiety contains ortho-alkoxy or ortho-aryloxy.

The couplers (A), (B) and (C) as described can be any cyan, magenta and yellow dye-forming couplers containing the described substituents that enable the color image formed upon exposure and processing of the described element to have the improved color saturation, better relation of speed to grain characteristics and reduced unwanted spectral absorption.

A preferred photographic element, as described, is such an element designed for use in a reversal photographic process, such as the E-6 process of Eastman Kodak Company, U.S.A. as described in, for example, the British Journal of Photography, 1982 Annual, pages 201-203. (KODAK is a trademark of Eastman Kodak Company, U.S.A.)

The cyan dye-forming coupler (A) is preferably a naphtholic coupler represented by the formula:

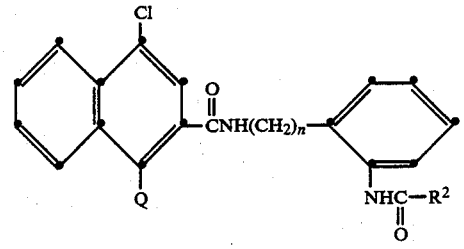

wherein Q is a substituted phenoxy coupling-off group; n is 1 to 4, preferably 2; and $R^2$ is unsubstituted or substituted alkyl, such as alkyl containing 1 to 30 carbon atoms, for example, methyl, ethyl, propyl, n-butyl, t-butyl, or eicosyl; or aryl, such as aryl containing 6 to 30 carbon atoms, for example phenyl or. The described naphtholic coupler can also contain substituents that do not adversely affect the described properties of the coupler and color photographic element, such as alkyl groups. The naphtholic coupler as described can be a monomeric compound or be part of an oligomeric or polymeric compound. For example, the phenoxy coupling-off group can be part of a backbone of a polymer.

The substituted phenoxy coupling-off group (Q) is preferably represented by the formula:

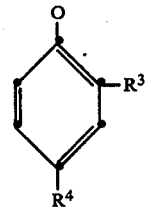

wherein $R^3$ is hydrogen or a group that does not adversely affect the properties of the coupler, such as an ortho-substituent as described in U.S. Pat. No. 4,401,752, the disclosures of which are incorporated herein by reference; $R^4$ is hydrogen or a substituent that does not adversely affect the properties of the coupler, such as halogen alkyl, alkoxy, nitro, cyano, thioether, carboxy, alkoxycarbonyl, aryloxycarbonyl, alkylsulfonyl, arylsulfonyl, amido ($-NR^5COR^6$), carbamoyl ($-CONR^7R^8$), sulfonamido ($-NR^9SO_2R^{10}$), and sulfamyl ($-SO_2NR^{11}R^{12}$). $R^3$ is preferably a group represented by the formula

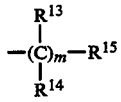

wherein $R^{13}$ and $R^{14}$ individually are hydrogen, alkyl or aryl; and, $R^{15}$ is a moiety containing a polarizable carbonyl, sulfonyl or phosphinyl group, such as selected from

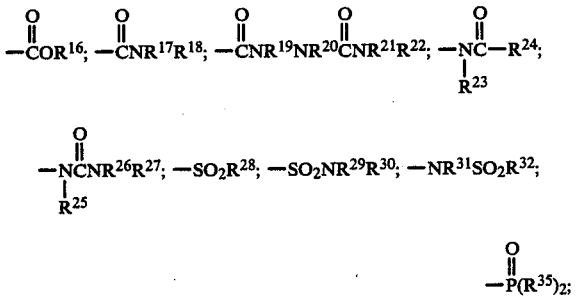

wherein $R^5$, $R^6$, $R^7$, $R^8$, $R^9$, $R^{10}$, $R^{11}$, $R^{12}$, $R^{16}$, $R^{17}$, $R^{18}$, $R^{19}$, $R^{20}$, $R^{21}$, $R^{22}$, $R^{23}$, $R^{24}$, $R^{25}$, $R^{26}$, $R^{27}$, $R^{28}$, $R^{29}$, $R^{30}$, $R^{31}$, $R^{32}$, $R^{33}$ and $R^{36}$ individually are hydrogen, alkyl, such as alkyl containing 1 to 20 carbon atoms, or aryl, such as aryl containing 6 to 20 carbon atoms.

Preferred examples of coupler (A) are:

(Coupler C-1)

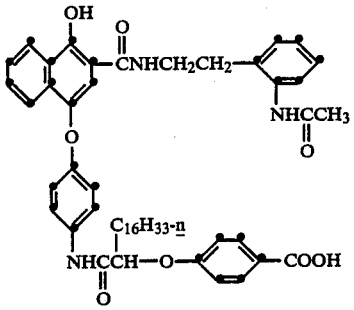

-continued (Coupler C-2)

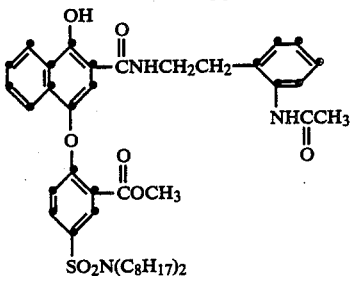

(Coupler C-3)

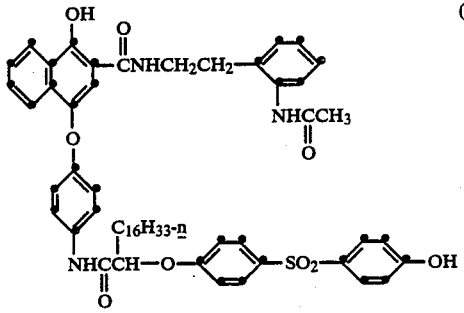

(Coupler C-4)

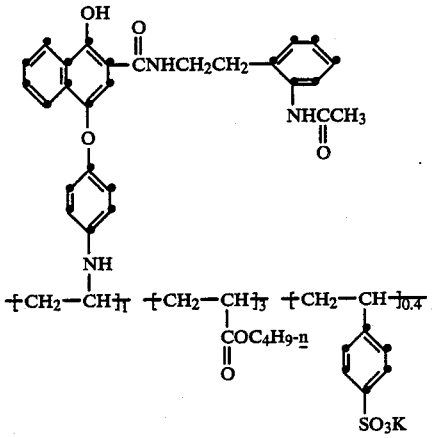

(Coupler C-5)

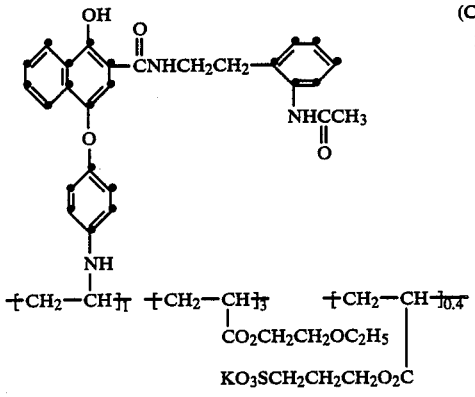

The magenta dye-forming coupler (B) is preferably represented by the formula:

(X) (II)

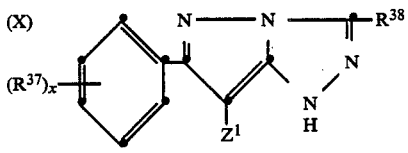

-continued or (Y) (II)

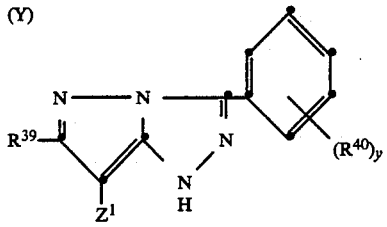

wherein $Z^1$ is hydrogen or a coupling-off group known in the photographic art, preferably chlorine; and, $R^{37}$, and $R^{40}$ individually are unsubstituted or substituted alkyl containing 1 to 4 carbon atoms, such as methyl, ethyl, propyl, n-butyl and t-butyl or alkoxy, particularly unsubstituted or substituted alkoxy containing 1 to 30 carbon atoms, such as methoxy, ethoxy, hexyloxy and dodecyloxy; and $R^{38}$ and $R^{39}$ individually are alkyl, such as methyl, ethyl, propyl, n-butyl and t-butyl; x and y individually are 0, 1, 2, 3, 4 or 5. The phenyl groups containing $R^{37}$ and $R^{38}$ preferably also comprise a ballast group (BALL) known in the photographic art. Typical couplers within (B) are described in, for example, European Patent Application Nos. 200,354, 284,239, and copending U.S. Ser. No. 265,197 of Bowne et al, filed Oct. 31, 1988 and U.S. Ser. No. 265,155 of Harder filed Oct. 31, 1988, the disclosures of which are incorporated herein by reference.

A particularly preferred magenta dye-forming coupler (B) is represented by the formula:

(III)

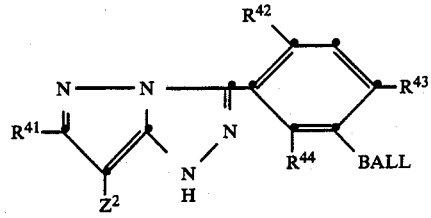

wherein $Z^2$ is hydrogen or a coupling-off group known in the photographic art, preferably chlorine; $R^{41}$, $R^{42}$, $R^{43}$ and $R^{44}$ individually are alkyl containing 1 to 4 carbon atoms, such as methyl, ethyl, propyl, n-butyl and t-butyl; and BALL is a ballast group known in the photographic art. Typical couplers within this formula are described in copending U.S. Ser. No. 171,061, filed Mar. 21, 1988 and European Patent Application No. 284,239, the disclosures of which are incorporated herein by reference.

Preferred examples of coupler (B) are:

(Coupler M-1)

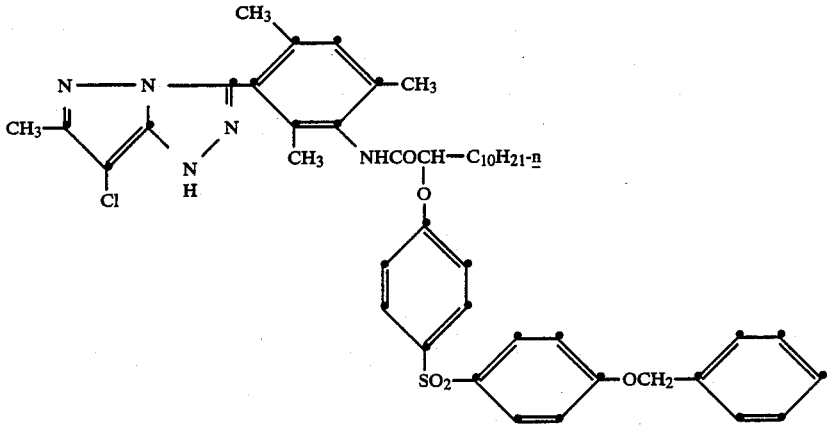

(Coupler M-2)

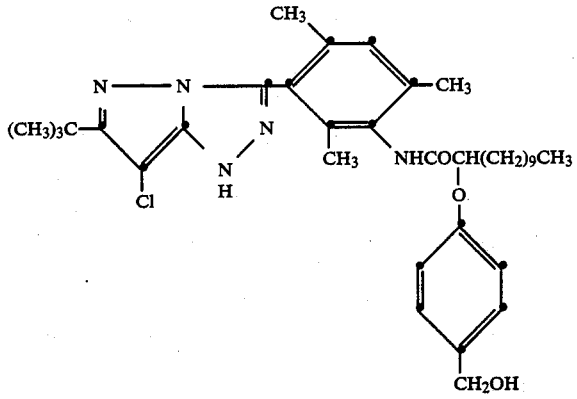

-continued

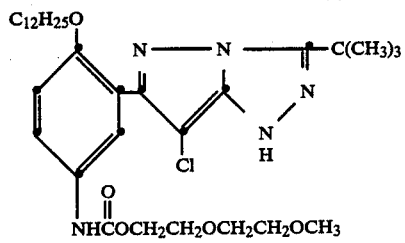

(Coupler M-3)

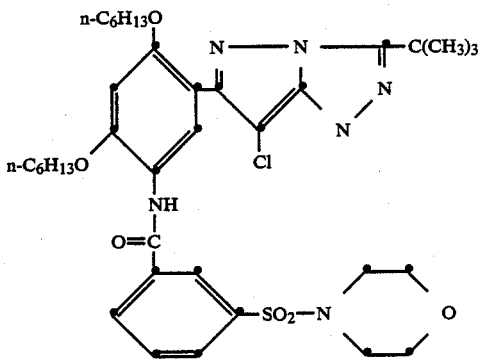

(Coupler M-4)

The yellow dye-forming coupler (C) is preferably represented by the formulas:

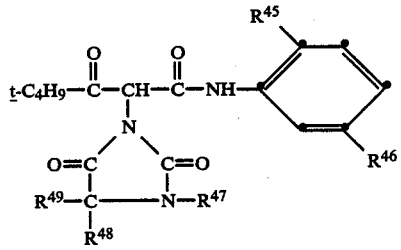

(IV)

wherein $R^{45}$ is chlorine or alkyl containing 1 to 4 carbon atoms, such as methyl, ethyl, propyl, n-butyl, and t-butyl; $R^{46}$ is $—COOR^{50}$ wherein $R^{50}$ is a ballast group known in the photographic art; $R^{47}$ is a benzyl group; $R^{48}$ is hydrogen or alkyl, such as alkyl containing 1 to 4 carbon atoms, such as methyl, ethyl, propyl, or n-alkyl; and, $R^{49}$ is alkoxy, such as alkoxy containing 1 to 4 carbon atoms, for example, methoxy, ethoxy, propoxy and butoxy; or

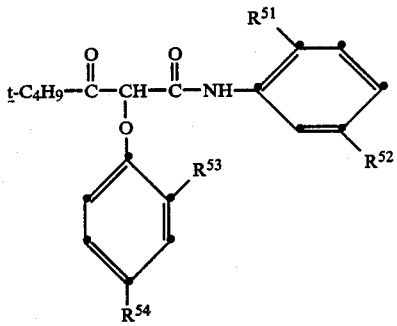

(V)

wherein $R^{51}$ is unsubstituted or substituted alkoxy, such as alkoxy containing 1 to 20 carbon atoms, for example, methoxy, ethoxy, propoxy, or butoxy; or unsubstituted or substituted aryloxy, such as aryloxy containing 6 to 20 carbon atoms, for example, phenoxy; $R^{52}$ is carbonamido ($—NHCOR^{53a}$), carboxylic acid ester ($—COOR^{54a}$), sulfamyl ($—SO_2NHR^{55}$), sulfonamido ($—NHSO_2R^{56}$), carbamyl ($—CONHR^{57}$) or esters $$(—O—\overset{O}{\overset{\|}{C}}—R^{58});$$

$R^{53}$ and $R^{54}$ are individually hydrogen or substituents that do not adversely affect desired hue and enable desired reactivity. $R^{53a}$, $R^{54a}$, $R^{55}$, $R^{56}$, $R^{57}$ and $R^{58}$ individually are substituents that do not adversely affect the described coupler, such as unsubstituted or substituted alkyl or aryl. At least one of $R^{51}$ and $R^{52}$ comprises a ballast group known in the photographic art. $R^{53}$ is preferably hydrogen or a group having ortho to the oxygen atom of the phenoxy group, a polarizable carbonyl, sulfonyl or phosphinyl substituent group, such as described in U.S. Pat. No. 4,401,752, the disclosures of which are incorporated herein by reference. $R^{54}$ is, for example, hydrogen or halogen, preferably chlorine, bromine or fluorine, alkyl, alkoxy, nitro, cyano, carboxy, alkoxycarbonyl, aryloxycarbonyl, alkylsulfonyl, arylsulfonyl, amido, carbamyl, sulfonamido or sulfamyl. $R^{53}$ is, for example, a group represented by the formula:

$$—\underset{\underset{R^{60}}{|}}{\overset{\overset{R^{59}}{|}}{(C)_m}}—A$$

wherein A is a group, as described in U.S. Pat. No. 4,401,752, preferably $—NHCOR^{61}$, $—CONR^{62}R^{63}$, $—SO_2R^{64}$, $—NHSO_2R^{65}$, or $—SO_2NR^{66}R^{67}$; m is 0 to 4; $R^{59}$ and $R^{60}$ individually are hydrogen, alkyl, or aryl; $R^{61}$, $R^{62}$, $R^{63}$, $R^{64}$, $R^{65}$, $R^{66}$ and $R^{67}$ individually are hydrogen, alkyl or aryl, preferably unsubstituted or substituted alkyl of 1 to 20 carbon atoms.

Preferred examples of coupler (C) are:

(Coupler Y-1)
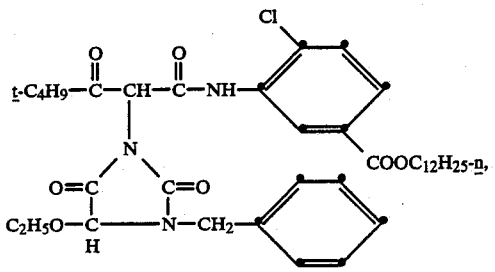
(Coupler Y-2)
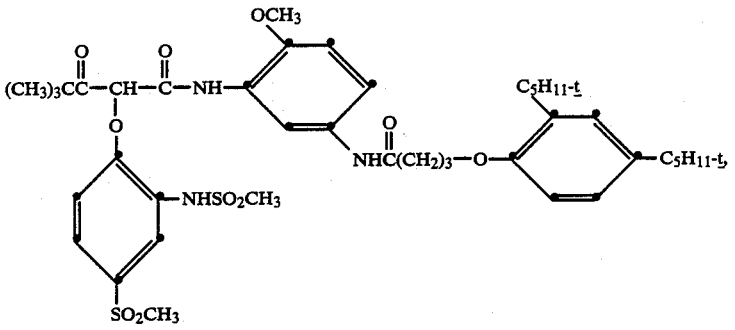
(Coupler Y-3)
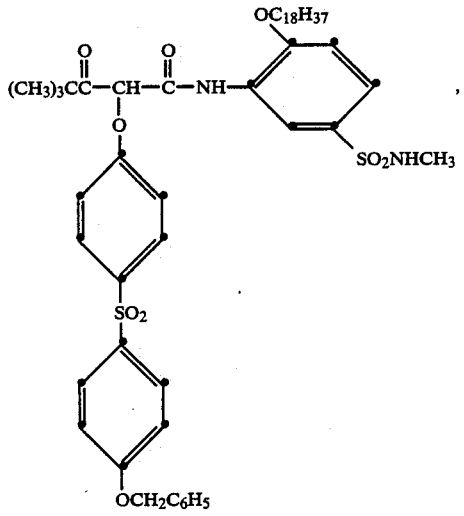
(Coupler Y-4)
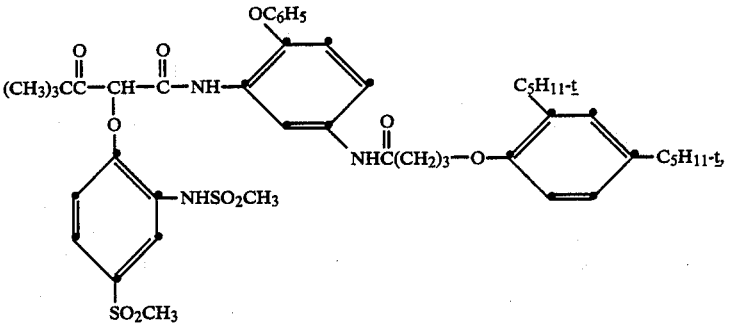

-continued

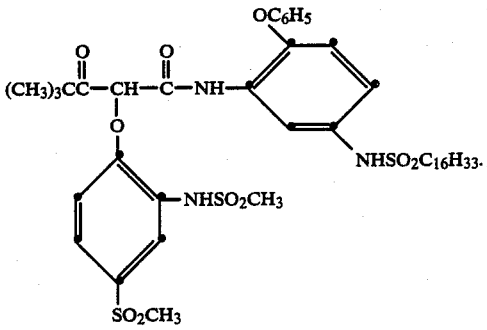

(Coupler Y-5)

One embodiment of the invention is a color photographic silver halide element comprising a support bearing at least one red-sensitive silver halide emulsion layer comprising a coupler (A) as described, at least one green-sensitive silver halide emulsion layer comprising a coupler (B) as described, and, at least one blue-sensitive silver halide emulsion layer comprising a coupler (C) as described.

Another embodiment of the invention is a process of forming a photographic image by developing an exposed color photographic silver halide element as described with a color photographic developing agent, preferably a process for forming a positive (reversal) image comprising development of the exposed element as described first with a non-chromogenic developing agent to develop exposed silver halide, but not form dye, and then uniformly fogging the element to render the unexposed silver halide developable, followed by forming a color photographic image by development of the element with a color developing agent. Development is followed by the conventional steps of bleaching, fixing, or bleach-fixing, to remove silver or silver halide, washing and drying. Such processes and processing compositions are described in, for example, British Journal of Photography Annual, 1977, pages 194–197 and British Journal of Photography Annual, 1982, pages 201–203. Such a preferred process in which the described element is useful is the E-6 process of Eastman Kodak Company, U.S.A.

The described couplers can be used in the layers of the color photographic silver halide element in ways that couplers have been used in the photographic art. In the photographic element the couplers should be of such molecular size and configuration that they will not significantly diffuse or wander from the layer in which they are coated.

The color photographic silver halide element as described can be processed by techniques known in the photographic art for forming dye images. For example, for formation of a reversal image the color photographic silver halide element can be processed in a reversal process available in the photographic art, such as the E-6 process of Eastman Kodak Co., U.S.A.

The layers of the color photographic element as described, including the layers of the image-forming units, can be arranged in various orders known in the photographic art. The element can contain added layers, such as filter layers, interlayers, overcoat layers, subbing layers, and the like.

The coupling-off groups, as described, can be any coupling-off groups known in the photographic art, such as described in European Patent Application No. 284,239, that do not adversely affect the described photographic element and process.

The ballast group BALL, as described, can also be any ballast group known in the photographic art, such as described in European Patent Application No. 284,239, that does not adversely affect the described photographic element and process. Preferred ballast groups are those that enable a narrower half-band width (HBW) of absorption of the dye formed from the coupler.

In the following discussion of materials useful in the emulsions and elements of the invention, reference will be made to Research Disclosure, December 1978, Item No. 17643, published by Industrial Opportunities Ltd., Homewell Havant, Hampshire, P09 1EF, U.K., the disclosures of which are incorporated herein by reference. The publication will be identified hereinafter by the term "Research Disclosure".

The silver halide emulsions employed in the elements can be comprised of silver bromide, silver chloride, silver iodide, silver chlorobromide, silver chloroiodide, silver bromoiodide, silver chlorobromoiodide or mixtures thereof. The emulsions can include coarse, medium or fine silver halide grains. High aspect ratio tabular grain emulsions are specifically contemplated, such as those described by Wilgus U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in GB No. 1,027,146; JA No. 54/48,521; U.S. Pat. Nos. 4,379,837; 4,444,877; 4,665,012; 4,686,178; 4,565,778; 4,728,602; 4,668,614; 4,636,461; EP No. 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure*, Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and poly- nuclear cyanines and merocyanines), oxonols, hemioxonols, styryls, merostyryls, and streptocyanines. Illustrative spectral sensitizing dyes are disclosed in *Research Disclosure*, Item 17643, cited above, Section IV.

Suitable vehicles for the emulsion layers and other layers of elements of this invention are described in Research Disclosure Item 17643, Section IX and the publications cited therein.

In addition to the couplers described herein the elements of this invention can include additional couplers as described in Research Disclosure Section VII, paragraphs D, E, F and G and the publications cited therein. These additional couplers can be incorporated as described in Research Disclosure Section VII, paragraph C and the publications cited therein.

The photographic elements of this invention can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure Section X), coating aids (Research Disclosure Section XI), plasticizers and lubricants (Research Disclosure Section XII), antistatic agents (Research Disclosure Section XIII), matting agents (Research Disclosure Section XVI) and development modifiers (Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N-(2-methoxyethyl)-m-toluidine di-p-toluene sulfonic acid.

The couplers as described can be prepared by methods and steps known in the organic synthesis art.

A typical method of preparing a coupler (C) is described in U.S. Pat. No. 4,022,620. A typical method of preparing a coupler (B) is described in European Patent Application No. 284,239. Typical methods known in the photographic art for preparing naphtholic couplers with aryloxy coupling-off groups, such as described in British Patent No. 1,084,480, can be used for preparing a coupler (A) as described.

The following examples further illustrate the invention:

EXAMPLE 1

Photographic Elements Comprising Couplers of the Invention

Photographic elements were prepared by coating a cellulose acetate-butyrate film support with a photosensitive layer containing a silver bromoiodide emulsion and 3.77 gm/m$^2$ gelatin. The cyan and magenta dye-forming couplers were coated with 0.91 gm Ag/m$^2$ at a level of 1.62 mmole/m$^2$ of the coupler. The yellow dye-forming couplers were coated with 0.76 gm Ag/m$^2$ at a level of 2.7 mmole/m$^2$ of the coupler. The magenta dye-forming couplers were dispersed in half their weight of tricresyl phosphate, while the yellow and cyan dye-forming couplers were dispersed in half their weight of di-n-butyl phthalate. The photosensitive layer was overcoated with a layer containing gelatin at 1.08 gm/m$^2$ and bis-vinylsulfonylmethyl ether at 1.75 weight percent based on total gelatin.

Samples of each element were imagewise exposed through a graduated-density test object and processed using E-6 processing solutions and methods with a shortened first development time of 2.5 minutes. The E-6 processing solutions were like those described in the British Journal of Photography, 1982 Annual, pages 201–203. The spectrophotometry of these samples at a density of one were measured and the resulting $\lambda$max and half-band width (HBW) measurements are listed in Table I.

TABLE I

| Coupler | $\lambda$max | HBW |
|---|---|---|
| C-A | 659 | 137 |
| C-2 | 649 | 108 |
| M-A | 551 | 90 |
| M-B | 548 | 84 |
| M-1 | 555 | 80 |
| M-2 | 557 | 80 |
| M-3 | 553 | 80 |
| M-4 | 556 | 78 |
| Y-A | 449 | 89 |
| Y-2 | 440 | 89 |
| Y-3 | 447 | 85 |

Results for the listed couplers are given in following Table II.

TABLE II

| Couplers | | | | Blue | Green | Red |
|---|---|---|---|---|---|---|
| Cyan | Magenta | Yellow | | C* | C* | C* |
| C-A | M-A | Y-2 | (Comparison) | 82.3 | 48.6 | 72.1 |
| C-A | M-1 | Y-A | (Comparison) | 91.6 | 48.4 | 82.6 |
| C-2 | M-A | Y-A | (Comparison) | 77.1 | 49.8 | 71.2 |
| C-A | M-1 | Y-2 | (Comparison) | 93.6 | 51.2 | 82.8 |
| C-2 | M-1 | Y-1 | (Invention) | 89.8 | 54.3 | 82.3 |
| C-2 | M-1 | Y-2 | (Invention) | 90.9 | 54.8 | 81.5 |

TABLE II-continued

Coupler C-A:

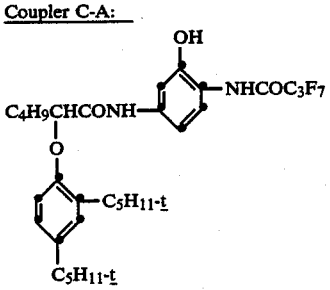

Coupler M-A:

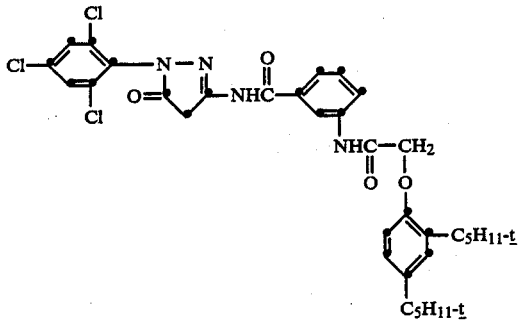

Coupler Y-A:

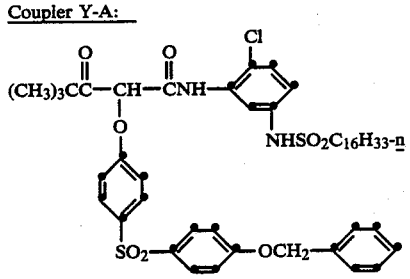

Using the full spectral absorption measurements for the image dyes along with measurements of tungsten illumination and spectral reflectances of test objects, the estimates of the reproduction of color saturation (C*) for blue, green and red test objects in Table II were determined. Larger values of C* indicate increases in color saturation.

Combinations of the invention allow increases in color saturation, particularly in the reproduction of green objects.

The invention has been described in detail with particular reference to particular embodiments thereof, but it will be understood that variations and modifications can be effected within the spirit and scope of the invention.

What is claimed is:

1. A color photographic silver halide element comprising a support bearing at least one red-sensitive silver halide emulsion layer comprising at least one cyan dye-forming coupler, at least one green-sensitive silver halide emulsion layer comprising at least one magenta dye-forming coupler and at least one blue-sensitive silver halide emulsion layer containing at least one yellow dye-forming coupler wherein (A) the cyan dye-forming coupler is a naphtholic coupler comprising in the 2- position an amide group represented by the formula:

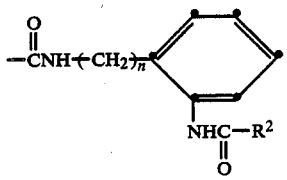

wherein n is 1 to 4 and $R^2$ is alkyl or aryl; and comprising in the 4- position a substituted phenoxy ballast group;

(B) the magenta dye-forming coupler is a pyrazolo[3,2-c]-s-triazole comprising a substituted or unsubstituted phenyl group in the 3-position or 6-position; and, (C) the yellow dye-forming coupler is a 2-equivalent pivaloylacetanilide coupler comprising a substituted hydantoin or phenoxy coupling-off group; when the coupling-off group is phenoxy, the anilide moiety contains ortho-alkoxy or ortho-aryloxy.

2. A color photographic element as in claim 1 wherein the cyan dye-forming coupler is represented by the formula:

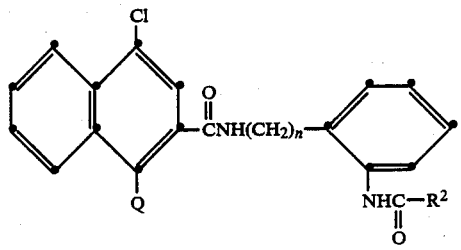

wherein

Q is a substituted phenoxy coupling-off group; n is 1 to 4; and $R^2$ is unsubstituted or substituted alkyl or aryl;

the magenta dye-forming coupler is represented by the formula:

(X)

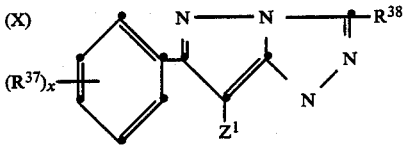

(II)

or (Y)

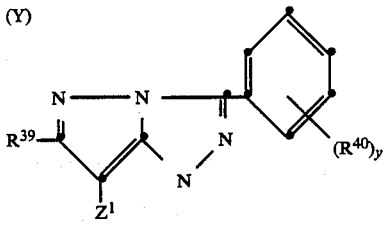

(II)

wherein $Z^1$ is hydrogen or a coupling-off group;

$R^{37}$ and $R^{40}$ individually are unsubstituted or substituted alkyl groups containing 1 to 4 carbon atoms or alkoxy; x and y individually are 1 to 5; and, $R^{38}$ and $R^{39}$ individually are alkyl; and, the yellow dye-forming coupler is represented by the formula:

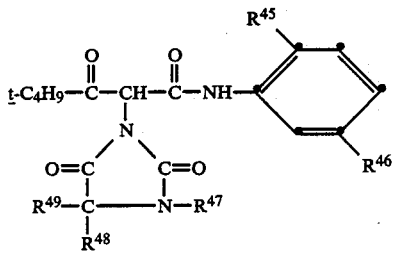

wherein $R^{45}$ is chlorine, alkyl containing 1 to 4 carbon atoms or alkoxy containing 1 to 4 carbon atoms;

$R^{46}$ is —$COOR^{50}$ wherein $R^{50}$ is a ballast group;

$R^{47}$ is benzyl;

$R^{48}$ is hydrogen or alkyl; and, $R^{49}$ is alkoxy.

3. A color photographic silver halide element comprising a support bearing at least one red-sensitive silver halide emulsion layer containing a cyan dye-forming coupler represented by the formula:

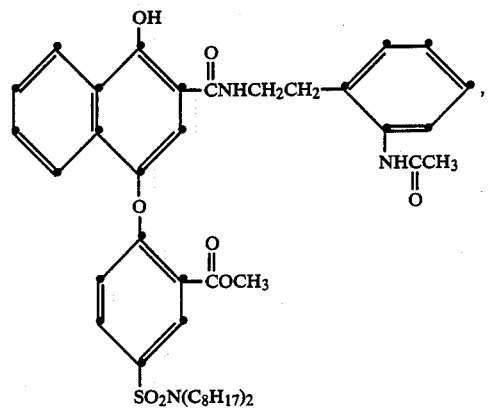

at least one green-sensitive silver halide emulsion layer containing at least one magenta dye-forming coupler represented by the formula:

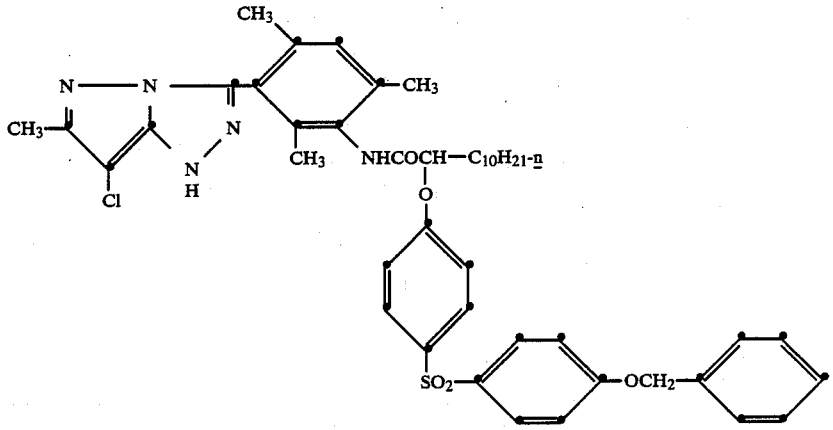

or

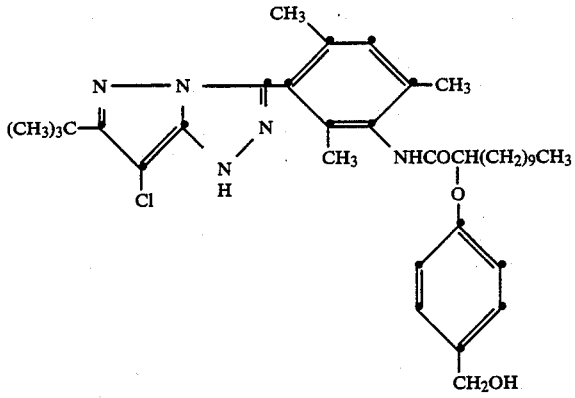

and at least one blue-sensitive silver halide emulsion layer containing a yellow dye-forming coupler represented by the formula:

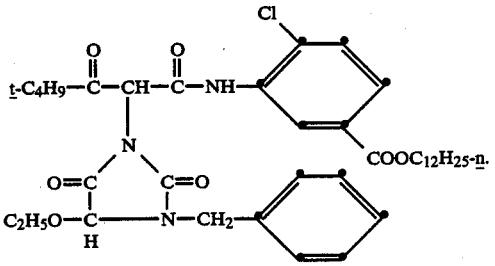

4. A process of forming a dye image in an exposed photographic element as defined in claim 1, said process comprising the step of reacting at least one of the couplers with an oxidized color developing agent to form a dye.

5. A process of forming a reversal dye image in an exposed photographic silver halide element as defined in claim 1, said process comprising the steps of black-and-white development with at least one black-and-white silver halide developing agent followed by a single color development of the element with at least one color developing agent to form a reversal dye image.

6. A process of forming a reversal dye image in an exposed photographic silver halide element as defined in claim 3, said process comprising the steps of black-and-white development with at least one black-and-white silver halide developing agent followed by a single color development of the element with at least one color developing agent to form a reversal dye image.

* * * * *

UNITED STATES PATENT AND TRADEMARK OFFICE

CERTIFICATE OF CORRECTION

PATENT NO. :4,960,685

DATED :October 2, 1990

INVENTOR(S) :Arlyce T. Bowne

It is certified that error appears in the above-identified patent and that said Letters Patent is hereby corrected as shown below:

Column 2, line 44, that part of formula reading

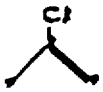

should read

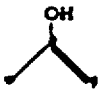

Signed and Sealed this

Twelfth Day of May, 1992

*Attest:*

DOUGLAS B. COMER

*Attesting Officer*

*Acting Commissioner of Patents and Trademarks*